US005863045A

United States Patent [19]

Watson et al.

[11] Patent Number: 5,863,045

[45] Date of Patent: Jan. 26, 1999

[54] SCORE-KEEPING RING TOSS GAME

[76] Inventors: Lane V. Watson, 1103 Lewis Roberts Rd., Jefferson, Ga. 30549; Brian L. Akins, Rte. 2, Box 1 Meadow St., Comer, Ga. 30629

[21] Appl. No.: 967,429

[22] Filed: Nov. 10, 1997

[51] Int. Cl.[6] ..... A63B 67/06

[52] U.S. Cl. ..... 273/336; 273/377

[58] Field of Search ..... 273/336, 338, 273/371, 377

[56] References Cited

U.S. PATENT DOCUMENTS

| | | | |
|---|---|---|---|
| 3,024,025 | 3/1962 | Richardson et al. | 273/336 X |
| 3,582,076 | 6/1971 | Keller | 273/377 |
| 4,120,499 | 10/1978 | Stazzone | 273/338 |
| 4,203,592 | 5/1980 | Quatkemeyer | 273/336 |
| 4,982,966 | 1/1991 | Teafatiller | 273/338 |
| 4,989,880 | 2/1991 | Gehemeier et al. | 273/336 |
| 5,018,745 | 5/1991 | Dunse | 273/338 |
| 5,040,801 | 8/1991 | Weymuth | 273/338 |
| 5,067,727 | 11/1991 | Crompton | 273/336 |

*Primary Examiner*—William H. Grieb
*Attorney, Agent, or Firm*—Joseph N. Breaux

[57] ABSTRACT

A score-keeping ring toss game comprising a target and a target switch member which transitions from an open state to a closed state when the target is rung by a ring-shaped member. A proximity switch member comprising a plurality of concentric circles around the target is provided wherein the proximity switch member produces a closed circuit if the ring-shaped member misses the target and engages the plurality of concentric circles. The target switch member and the proximity switch member are coupled to a control unit for determining if the target switch member has transitioned to the closed state or whether the proximity switch member has produced the closed circuit for producing an output signal on a first output path or a second output path. The output signal is accumulated and displayed for each player.

16 Claims, 4 Drawing Sheets

SCORE-KEEPING RING TOSS GAME

TECHNICAL FIELD

The present invention relates to lawn games and more particularly to a score-keeping ring toss game which automatically keeps score for each player or team and automatically varies the amount of points given for each toss based on at least two conditions.

BACKGROUND OF THE INVENTION

Ring toss games played on the lawn are well known. Each player or team takes a turn tossing a washer or the like (hereinafter referred to as washer) in an attempt to ring the target with the washer. Points are accumulated as each player rings the washer around the target or comes within close proximity to the target. As is evident, the washer game is similar to the horseshoe game.

Several devices have been patented which are aimed at ring toss games, such as those described in U.S. Pat. No. 4,120,499, by Stazzone; U.S. Pat. No. 4,203,592, by Quatkemeyer; U.S. Pat. No. 4,982,966, by Teafatiller; U.S. Pat. No. 4,989,880, by Gettemeier et al.; U.S. Pat. No. 5,018,745, by Dunse; U.S. Pat. No. 5,040,801, by Weymuth; and, U.S. Pat. No. 5,067,727, by Crompton. While each of the above ring toss games function as desired, none of them automatically keep score. A ring toss game which automatically keeps score is highly desirable for those who are lazy. Additionally, because the players must stand a significant distance from the target, the players often get frustrated when they have to repeatedly walk to the target to determine if the washer came in close enough proximity to the target in order to get points. Furthermore, the players must remember the accumulated score while playing the game or maintain a written tally of the points accumulated during the game.

It can be readily seen that there exists the continuing need for a score-keeping ring toss game which automatically keeps score for each player or team and varies the amount of points given for each toss based on at least two conditions.

SUMMARY OF THE INVENTION

The preferred embodiment of the score-keeping ring toss game of the present invention solves the aforementioned problems in a straight forward and simple manner. What is provided is a score-keeping ring toss game which automatically keeps score for each player or team and wherein the score-keeping function varies the amount of points given for each toss based on at least two conditions.

The score-keeping ring toss game of the present invention comprises a target; target switch means transitioning from an open state to a closed state when said target is rung by a ring-shaped member; proximity switch means for switching comprises a plurality of concentric circles around said target wherein said proximity switch means produces a closed circuit if said ring-shaped member misses said target and engages said plurality of concentric circles; control means for determining if said target switch means has transitioned to said closed state and whether said proximity switch means has produced said closed circuit for producing an output signal on a first output path or a second output path; and, first and second counter means coupled to said first output path and said second output path, respectively, for accumulating points in response to said output signal.

In view of the above, an object of the present invention is to provide a score-keeping ring toss game which switches between at least two players or at least two teams.

Another object of the present invention is to provide a score-keeping ring toss game which is capable of distinguishing between at least two conditions for varying the points given per toss.

A further object of the present invention is to provide a score-keeping ring toss game which is capable of being switched to the next player if the present player fails to score during his or her turn.

It is a still further object of the present invention is to provide a score-keeping ring toss game which provides points for those washer members which come in close proximity to the target thereby eliminating the need for the player to walk to the target to determine if points can be had for the toss.

It is a still further object of the present invention to provide a score-keeping ring toss game having a visual display means for displaying the score for each player or team thereby eliminating the need for the players to remember the accumulated score while playing the game or the need for the players to maintain a written tally of the points accumulated during the game.

It is a still further object of the present invention to provide a score-keeping ring toss game which is simple to use and easy to play.

It is a still further object of the invention to provide a score-keeping ring toss game which is simple and inexpensive to manufacture.

The above and other objects and features of the present invention will become apparent from the drawings, the description given herein, and the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
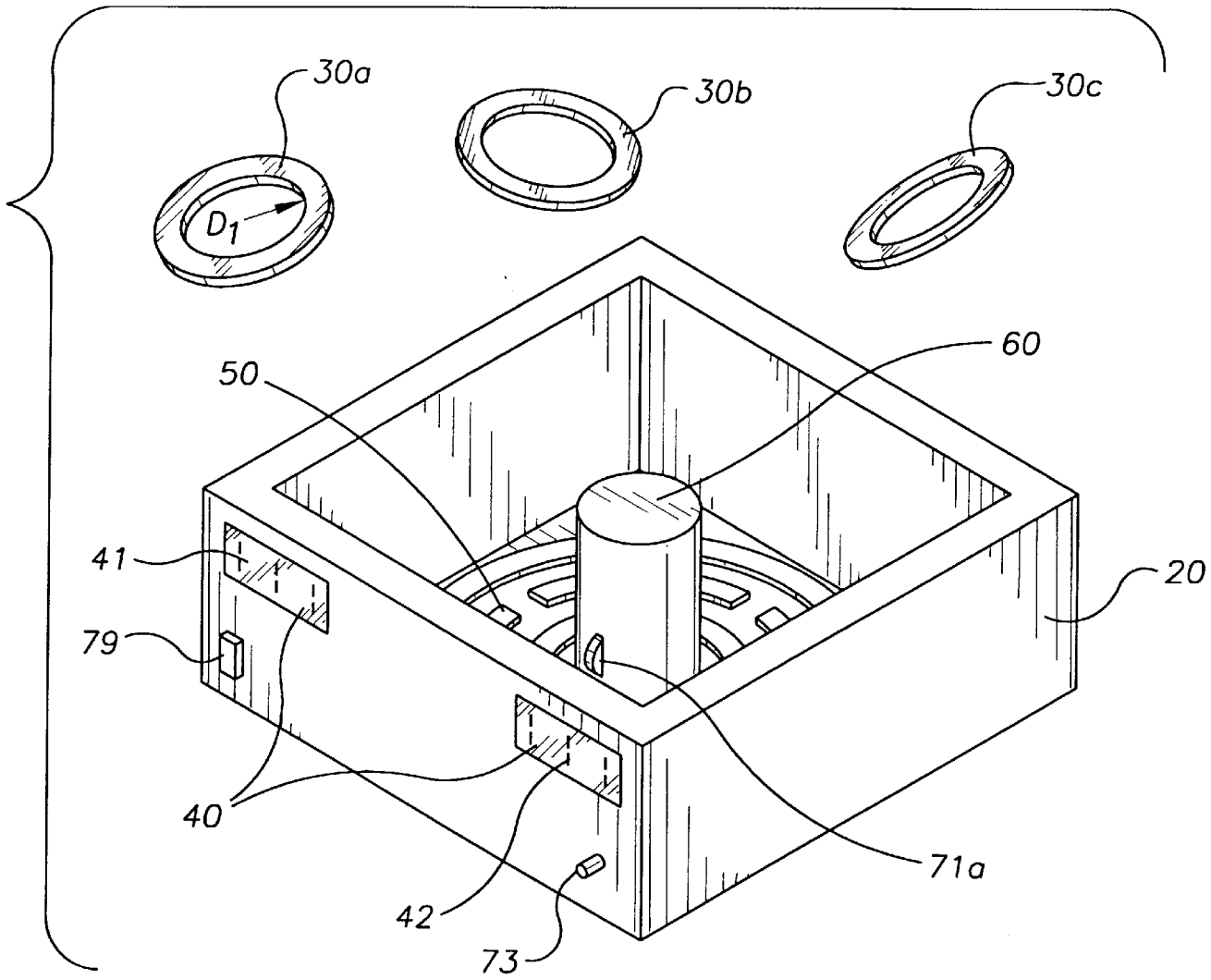
FIG. 1 illustrates a perspective view of the preferred embodiment of the score-keeping ring toss game of the present invention.
Figure 2:
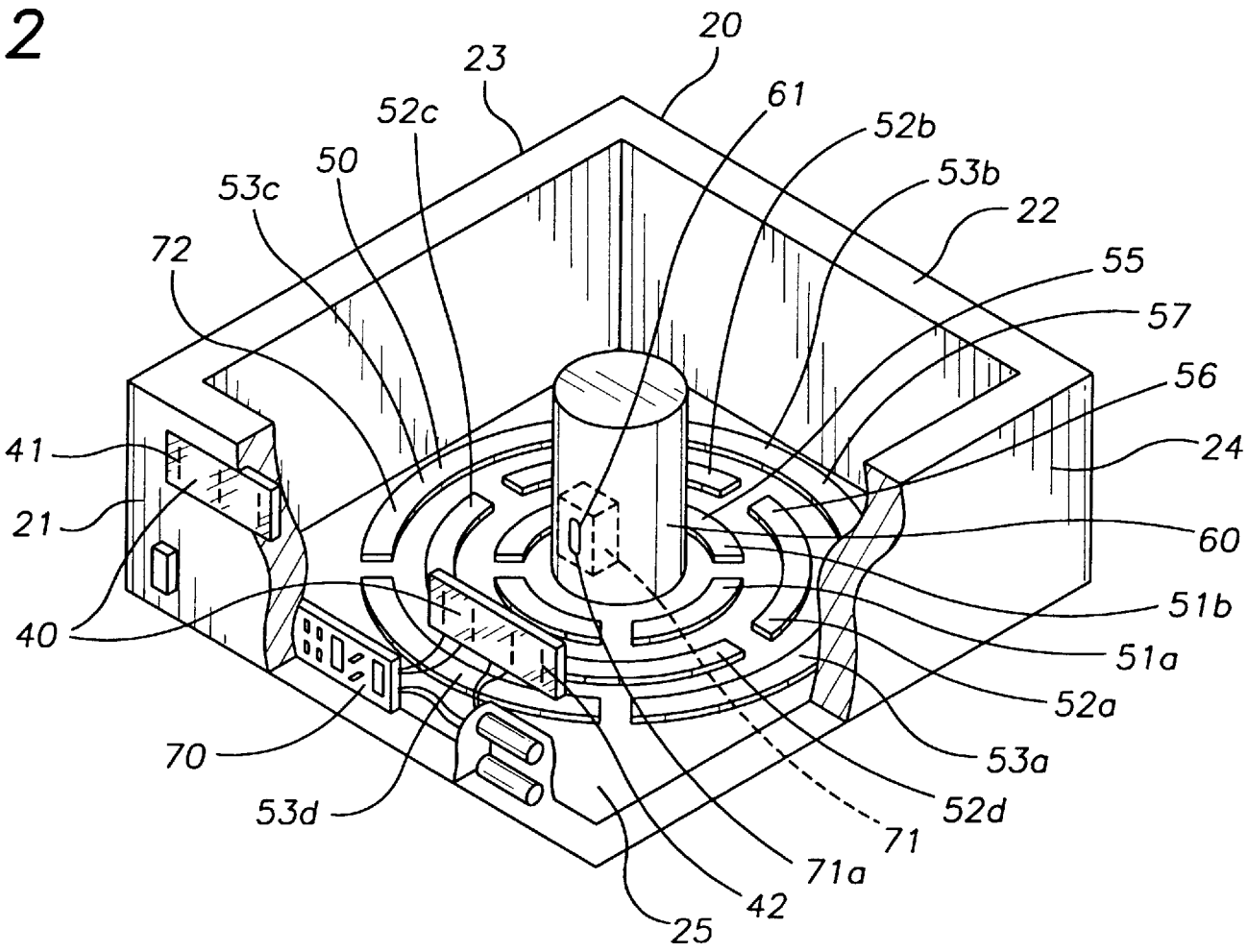
FIG. 2 illustrates a perspective view of the housing of the score-keeping ring toss game of FIG. 1 having a portion of the housing removed illustrating the electronic circuitry; and, FIG. 3 illustrates a schematic diagram of the electronic circuitry for keeping score when playing the score-keeping ring toss game of the present invention.

Referring now to the drawings, and in particular FIGS. 1 and 2, the score-keeping ring toss game of the present invention is designated generally by the numeral 10. Score-keeping ring toss game 10 is comprised of housing 20, three large, electrically conductive, metal washer members 30*a*, 30*b*, and 30*c*; three small, electrically conductive, metal washer members 31; visual display means 40, proximity scoring base 50, bull's eye post 60, and score-keeping circuitry 70.

Housing 20 comprises front wall 21, back wall 22, first side wall 23, second side wall 24 and bottom wall 25 coupled together to form an open top box-shaped housing. Front wall 21 accommodates visual display means 40 and in the preferred embodiment, reset switch means 73 and power on/off switch means 79. Nevertheless, reset switch means 73 and power on/off switch means 79 may be located on any of the walls of housing 20. Bottom wall 25 accommodates in the center thereof, bull's eye post 60 (the target) and proximity switch means 72.

Figure 1A:
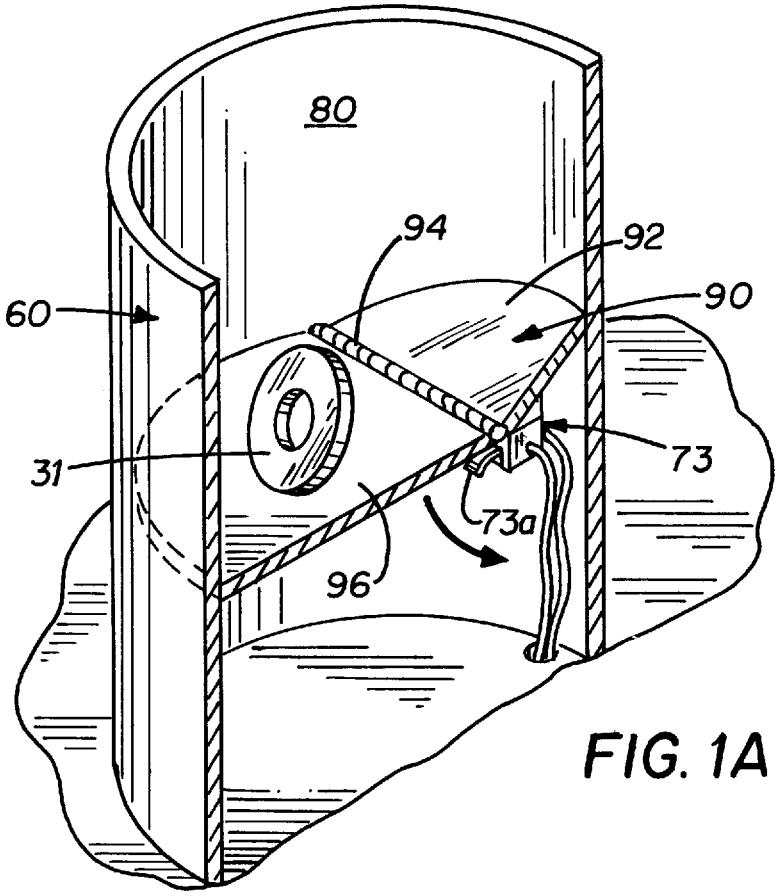
FIG. 1A is a cross sectional view of the bull's eye post of FIG. 1 along the line I—I showing one of the small washers positioned within the tubular washer receiving cavity of bull's eye post and the switch door assembly including the angled fixed portion, the spring biased hinge, the pivoting flap portion, and the switch assembly including the trigger lever positioned adjacent to the pivoting flap portion.

Bull's eye post 60 is a hollow cylindrical member located in the center of bottom wall 25 wherein the height of such hollow cylindrical member is at least the height of the walls of housing 20. Bull's eye post 60 has formed therein a sidewall aperture 61. The hollow interior of bull's eye post 60 accommodates therein a large washer target switch means 71 having lever-like member 71*a* projecting through aperture 61 to the exterior of bul's eye post 60. In the preferred embodiment, bull's eye post 60 is made of a durable material such as plastic or the like. As is known, one of the objects of the ring toss game is to successfully ring a large washer member 30*a–c* around bull's eye post 60 (the target) in order to accumulate points for the game. The other object is to throw small washers 31 into the tubular washer receiving cavity 80 of bull's eye post 60. With reference to FIG. 1A, tubular washer receiving cavity 80 has a switch door assembly, generally designated 90, having an angled fixed portion 92, a spring biased hinge 94, a pivoting flap portion 96, and a small washer switch assembly 73 having a trigger lever 73*a* that is actuated when pivoting flap portion 96 is caused to pivot downward under the 20 weight of a small washer 31. Use of an angled fixed portion 92 causes small washers 31 that land on angled fixed portion 92 to slide onto pivoting flap portion 96.

With reference back to FIGS. 1 and 2, each of the plurality of large washer members 30*a*, 30*b*, and 30*c* comprises a ring-shaped member having a hollow circular center. Such hollow circular center has diameter D1 greater than the external diameter of bull's eye post 60 thereby permitting the washer member to easily slide downward along the exterior of bull's eye post 60. However, diameter D1 is limited by the distance of projection of lever-like member 71*a* through aperture 61. Furthermore, such hollow circular center should be large enough to allow a player to grip the ring-shaped member. For exemplary purposes, there are three washer members given to each player. Nevertheless, any number of washer members may be provided, as desired, provided each player is given an equal number of washer members. In the preferred embodiment, the plurality of large washer members 30*a*, 30*b* and 30*c* are made of a non-corrosive electrically conductive material such as, without limitation, stainless steel.

In one method of playing the game, each player or team is given a set of the plurality of large washer members 30*a*, 30*b*, 30*c* and each player then takes a turn tossing one of the plurality of large washer members 30*a*, 30*b* and 30*c* in an attempt to successfully ring bull's eye post 60 (the target) with such one of the washer members. Nevertheless, oftentimes, the player fails to successfully ring bull's eye post 60 with such one of the large washer members 30*a–c* but such washer member 30*a–c* may come in very close proximity to bull's eye post 60. In such instances, score-keeping ring toss game 10 adds points to the players score when such washer member 30*a–c* comes in close proximity to bull's eye post 60. The score-keeping function of score-keeping ring toss game 10 provides points for those washer members 30*a–c* which come in close proximity to bull's eye post 60 thereby eliminating the need for the player to walk close enough to bull's eye post 60 to determine if points can be had for the toss.

Proximity scoring base 50 comprises a plurality of concentric circles 55, 56 and 57 centered round bull's eye post 60 (the target). Concentric circle 55 (hereinafter referred to as the inner concentric circle) comprises a first set of a plurality of arched shaped members 51*a*, 51*b*, 51*c* and 51*d*, each of which has a first arc length, and are equally spaced in a circle around bull's eye post 60. Moreover, concentric circle 55 is spaced a predetermined distance from the outer perimeter defined by bull's eye post 60 wherein such predetermined distance is at least the width of said ring-shaped member. Concentric circle 56 (hereinafter referred to as the middle concentric circle) comprises a second set of a plurality of arched shaped members 52*a*, 52*b*, 52*c*and 52*d*, each of which has a second arc length, and are equally spaced in a circle around the outer perimeter formed by said inner concentric circle. Concentric circle 55 is spaced a predetermined distance from the outer perimeter defined by said inner concentric circle. Concentric circle 57 (hereinafter referred to as the outer concentric circle) comprises a third set of a plurality of arched shaped members 53*a*, 53*b*, 53*c* and 53*d*, each of which has a third arc length, and are equally spaced in a circle around the outer perimeter formed by said middle concentric circle. Concentric circle 55 is spaced a predetermined distance from the outer perimeter defined by said middle concentric circle. In the exemplary embodiment, the first set, the second set and the third set of the plurality of arched shaped members comprise four arched shaped members. The arch length of the arched shaped members of the middle concentric circle is larger than the arch length of the arched shaped members of the inner concentric circle and smaller in length than the arch length of the arched shaped members of the outer concentric circle.

While the exemplary embodiment provides for four arch shaped members, any number of arch shaped members may be substituted by increasing or decreasing the arc length of each arch shaped member. Additionally, in lieu of varying the arch lengths of the arched shaped members for each such concentric circle, all arch shaped members of all concentric circles may have the same arch length. However, each concentric circle will require a different number of such arched shaped members. Moreover, there may be provided any number of concentric circles around bull's eye post 60 wherein increasing number of concentric circles increases the proximity range with respect to bull's eye post 60 (the target) in which a player may be given points.

The arched shaped members are made of an electrically conductive material such as without limitation, copper foil. In the preferred embodiment, proximity scoring base 50 is a circular printed circuit board having the pattern of the concentric circles formed into its surface wherein such pattern of the concentric circles is slightly raised above the plane of the circular printed circuit board. Proximity scoring base 50 provides a switching array wherein any two of the arched shaped members of any of the concentric circles provide an open circuit therebetween.

In operation, when one of the washer members is tossed and lands on proximity scoring base 50, as the electrically conductive material of such washer members engages the electrically conductive material of at least two of the arch shaped members, a closed circuit is formed. From the foregoing, proximity switch means 72 comprises proximity scoring base 50 in combination with the plurality of large washer members 30*a*, 30*b* and 30*c* wherein proximity switch means 72 is capable of producing a plurality of closed switches.

Figure 3:
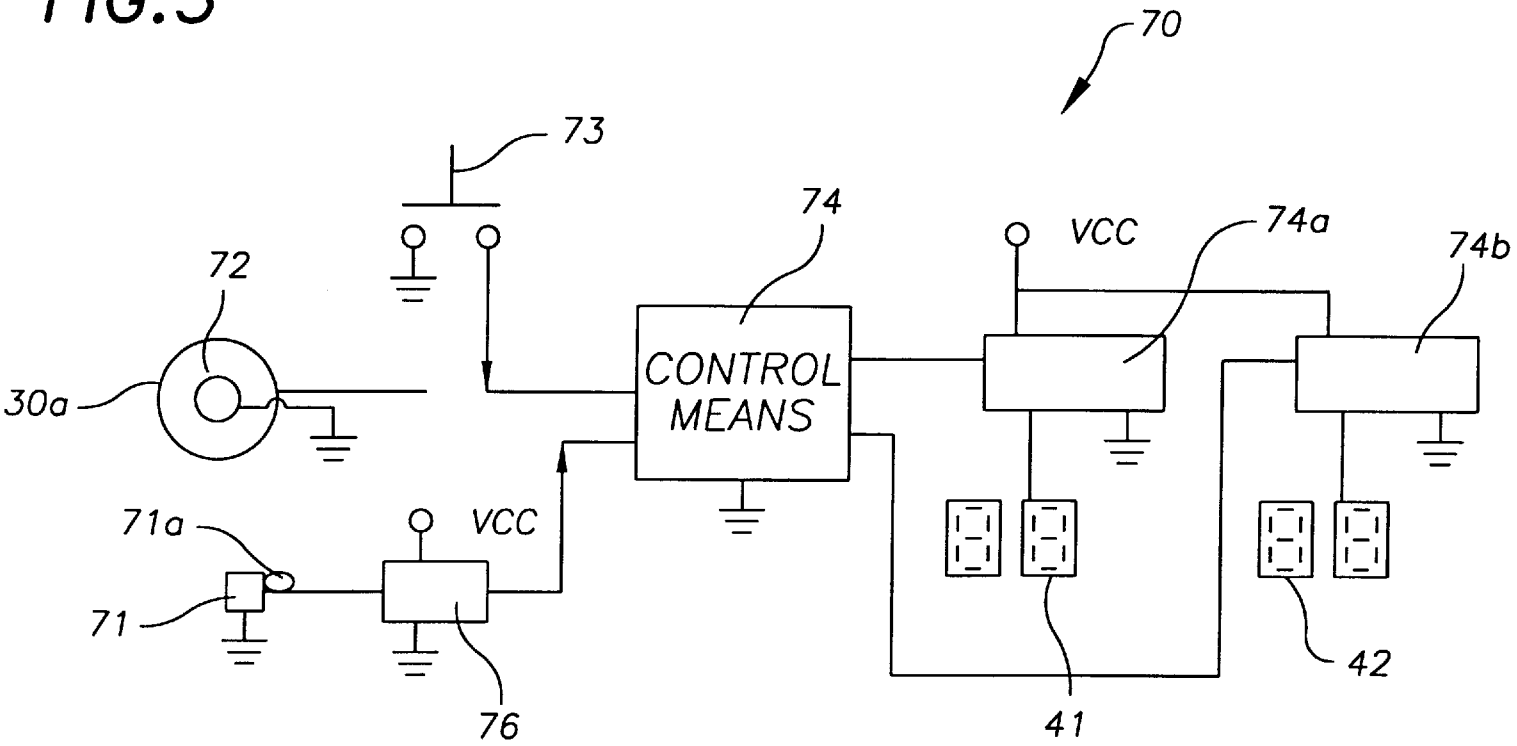

Referring to FIG. 3, score-keeping circuitry 70 comprises target switch means 71, proximity switch means 72, reset switch means 73, a small washer switch assembly 73 having a trigger lever 73*a*, control means 74, first and second counter/display driver means 74*a* and 74*b*, power switch means 79 (FIG. 1) and power source 75 (FIG. 2). Power switch means 79 when switched to an on position serves to allow electrical power from power source 75 to flow to the rest of the circuitry of score-keeping circuitry 70 via VCC, as is well known in the art. In the exemplary embodiment, power source 75 is located in front wall 21 of housing 20. Nevertheless, power source 75 may be located within said hollow cylindrical member or within any of the other wall of housing 20.

Target switch means 71 transitions from an open state to a closed state wherein in the closed state a pulse is generated indicating that a washer member has successfully rung bull's eye post 60 (the target). As the washer member slides down bull's eye post 60, lever-like member 71*a* projecting through aperture 61 of bull's eye post 60 is urged downward and inward. As the lever-like member 71*a* is urged downward and inward within aperture 61, target switch means 71 thereafter transitions from the open state to the closed state. After the pulse is generated in the closed state, lever-like member 71*a* returns to it original position, i.e., projecting through aperture 61. The output of target switch means 71 is coupled to multiplier 76 or the like wherein the pulse produced by target switch means 71 is multiplied by the number of points given for ringing the target. For example, if the target is made 5 or 10 points may be given. Therefore, the multiplier output sends a stream of 5 or 10 pulses, accordingly, to control means 74. Small washer switch assembly 73 is wired to multiplier 76 in the same manner as target switch means 71. Small washer switch assembly is activated when trigger lever 73*a* is actuated by the weight of a small washer 31 causing pivoting flap portion 96 to pivot downward. Proximity switch means 72 as described above serves to produce a single pulse when proximity switch means 72 forms a closed circuit.

Control means 74 interprets that the target has been rung by receipt of the 5 or 10 pulses on first input 77*a* or that the washer member landed within close proximity of bull's eye post 60 by the receipt of a single pulse on second input 77*b*. Control means 74 thereafter conveys either a single pulse or the *5* or *10* pulse to first counter/display driver means 74*a* or second counter/display driver means 74*b* depending on which player is tossing. After control means 74 receives an input via first input 77*a* or 77*b* and has conveyed the pulses to first counter/display driver means 74*a* or second counter/display driver means 74*b* via output paths 78*a* or 78*b*, respectively, output path 78*a* or 78*b* of control means 74 is switched to the other output path of output paths 78*a* and 78*b*. As each player or team takes a turn, the counters means of first and second counter/display driver means 74*a* and 74*b* accumulate points until the game is over and communicates such points, as accumulated, to visual display means 40. More specifically, the first counter/display driver means 74*a* is designated for the first player or team and the second counter/display driver means 74*b* is designated for the second player or team. Control means 74 may comprise flip flop circuits or the like.

Reset switch means 73, when actuated, produces a momentary pulse for transitioning score-keeping circuitry 70 between players wherein output paths 78*a* and 78*b* of control means 74 are switched. More specifically, reset switch means 73 is used to transition score-keeping circuitry 70 between players or teams if one of the players or teams does not make any points during their turn. In the preferred embodiment, a player will toss each of the plurality of large washer members 30*a*, 30*b* and 30*c* until points are obtained for the turn either by ringing the target or tossing the washer in close proximity to bull's eye post 60 wherein the washer lands within the region defined by concentric circles 55, 56, and 57. If a player or team has failed to make any points, than reset switch means 73 is actuated by a player to transition the output paths 78*a* and 78*b* of control means 74. Specifically, a player or team does not accumulate points if the washer member is not tossed into housing 20. Control means 74 receives the momentary pulse and switches its output from either first and second counter/display driver means 74*a* and 74*b* depending whose turn is up to the other of first and second counter/display driver means 74*a* and 74*b*. For example, if the first player failed to make any points than control means 74 switches its output from first counter/display driver means 74*a* to second counter/display driver means 74*b*.

Visual display means 40 comprises a numerical display for communicating to the players their scores wherein visual display means 40 is accommodated in front wall 21 of housing 20. Visual display means 40 displays the score for each player or team thereby eliminating the need for the players to remember the accumulated score while playing the score-keeping ring toss game 10 or the need for the players to maintain a written tally of the points accumulated during the game. In the preferred embodiment, visual display means 40 is a light emitting display capable of displaying at least two digits. Visual display means 40 comprises first and second displays 41 and 42 wherein first display 41 communicates the score of the first player or team and second display 42 communicates the score of the second player or team. First display 41 and second display 42 receive an input from first counter/display driver means 74*a* and second counter/display driver means 74*b* , respectively. In the preferred embodiment, first and second counter/display driver means 74*a* and 74*b* are BCD counter/decimal-decoder/drivers.

Although, the preferred embodiment provides for a single unit having a single target (bull's eye post 60) and score-keeping circuitry 70 switchable between two players or teams, the score-keeping toss game 10 may be modified such that housing 20, bull's eye post 60 and score-keeping circuitry 70 are duplicated. However, the reset switch means 73 may be omitted and each of the two housings will be provided with only one display panel. Furthermore, there is no need for control means 74 to switch its output paths between players, i.e., first and second counter/display driver means 74*a* and 74*b*.

It can be seen from the preceding description that score-keeping toss game 10 which automatically keeps score for each player; which distinguishes between at least two conditions for varying the points for each toss; and, which is simple to use, play and manufacture has been provided.

It is noted that the embodiment of the score-keeping ring toss game described herein in detail, for exemplary purposes, is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A score-keeping ring toss game comprising:

a target;

a target switch means transitioning from an open state to a closed state when said target is rung by a ring-shaped member;

a proximity switch means for switching comprises a plurality of concentric circles around said target wherein said proximity switch means produces a closed circuit if said ring-shaped member misses said target and engages said plurality of concentric circles;

control means for determining if said target switch means has transitioned to said closed state and whether said proximity switch means has produced said closed circuit for producing an output signal on a first output path or a second output path; and, first and second counter means coupled to said first output path and said second output path, respectively, for accumulating points in response to said output signal.

2. The score-keeping ring toss game of claim 1, wherein each concentric circle of said plurality of concentric circles comprises a plurality of arched shaped members made of electrically conductive material wherein any two of said plurality of arched shaped member of said plurality of concentric circles forms an open circuit.

3. The score-keeping ring toss game of claim 2, wherein said ring-shaped member is made of electrically conductive material and wherein if said ring-shaped member engages at least two of said arched shaped member said closed circuit is formed.

4. The score-keeping ring toss game of claim 1, further comprising:

first visual display means, coupled to an output of said first counter, for displaying a score of a first player; and, second visual display means, coupled to said second counter means, for displaying a score of a second player.

5. The score-keeping ring toss game of claim 4, further comprising a housing wherein said housing comprises:

a front wall;

a back wall;

a first side wall;

a second side wall; and, a bottom wall wherein said front wall, said back wall, said first side wall, said second side wall, and said bottom wall are coupled together to form an open top box-shaped housing and wherein said front wall accommodates at least said first visual display means and said bottom wall accommodates in the center thereof said target.

6. The score-keeping ring toss game of claim 1, wherein said control means switches to the other of said first output path or said second output path for delivering another output signal if said control means determines that said target switch means has transitioned to said closed state or that said proximity switch means has produced said closed circuit.

7. The score-keeping ring toss game of claim 6, further comprising reset switching means for switching said control means to the other of said first output path or said second output path if said ring-shaped member does not ring said target or engage said plurality of concentric circles of said proximity switch means.

8. The score-keeping ring toss game of claim 1, further comprising a multiplier means coupled to an output of said target switch means for multiplying said output by the amount of point to be given for ringing said target by said ring-shaped member.

9. A score-keeping ring toss game comprising:

a target;

target switch means transitioning from an open state to a closed state when said target is rung by a ring-shaped member;

proximity switch means for switching comprises a plurality of concentric circles around said target wherein said proximity switch means produces a closed circuit if said ring-shaped member misses said target and engages said plurality of concentric circles, wherein each concentric circle of said plurality of concentric circles comprises a plurality of arched shaped members made of electrically conductive material wherein any two of said plurality of arched shaped member of said plurality of concentric circles forms an open circuit;

control means for determining if said target switch means has transitioned to said closed state and whether said proximity switch means has produced said closed circuit for producing an output signal on a first output path or a second output path; and, first and second counter means coupled to said first output path and said second output path, respectively, for accumulating points in response to said output signal.

10. The score-keeping ring toss game of claim 9, wherein said ring-shaped member is made of electrically conductive material and wherein if said ring-shaped member engages at least two of said arched shaped member said closed circuit is formed.

11. The score-keeping ring toss game of claim 9, further comprising:

first visual display means, coupled to an output of said first counter, for displaying a score of a first player; and, second visual display means, coupled to said second counter means, for displaying a score of a second player.

12. The score-keeping ring toss game of claim 11, further comprising a housing wherein said housing comprises:

a front wall;

a back wall;

a first side wall;

a second side wall; and, a bottom wall wherein said front wall, said back wall, said first side wall, said second side wall, and said bottom wall are coupled together to form an open top box-shaped housing and wherein said front wall accommodates at least said first visual display means and said bottom wall accommodates in the center thereof said target.

13. The score-keeping ring toss game of claim 9, wherein said control means switches to the other of said first output path or said second output path for delivering another output signal if said control means determines that said target switch means has transitioned to said closed state or that said proximity switch means has produced said closed circuit.

14. The score-keeping ring toss game of claim 13, further comprising reset switching means for switching said control means to the other of said first output path or said second output path if said ring-shaped member does not ring said target or engage said plurality of concentric circles of said proximity switch means.

15. The score-keeping ring toss game of claim 9, further comprising a multiplier means coupled to an output of said target switch means for multiplying said output by the amount of point to be given for ringing said target by said ring-shaped member.

16. The score-keeping ring toss game of claim 1, wherein:

said target has a washer receiving cavity formed therein; and said ring toss game includes a switch door assembly including an angled fixed portion, a biased hinge, a pivoting flap portion pivotally connected to said angled fixed portion by said biased hinge, and a switch assembly including a trigger lever positioned adjacent to said pivoting flap portion; said trigger lever being actuated by a downward movement of said pivoting flap portion.

* * * * *